US008184815B2

(12) United States Patent
Kawano

(10) Patent No.: US 8,184,815 B2
(45) Date of Patent: May 22, 2012

(54) MICROPHONE UNIT FOR STEREOPHONIC RECORDING

(75) Inventor: Tatsuya Kawano, Tokyo (JP)

(73) Assignee: Kabushiki Kaisha Zoom, Tokyo (JP)

( * ) Notice: Subject to any disclaimer, the term of this patent is extended or adjusted under 35 U.S.C. 154(b) by 734 days.

(21) Appl. No.: 12/338,874

(22) Filed: Dec. 18, 2008

(65) Prior Publication Data

US 2010/0008511 A1 Jan. 14, 2010

(30) Foreign Application Priority Data

Jul. 8, 2008 (JP) ..... 2008-178468

(51) Int. Cl.
*H04R 5/00* (2006.01)

(52) U.S. Cl. ..... 381/26; 381/122; 381/355; 381/356; 381/357; 381/358; 381/365

(58) Field of Classification Search ..... 381/22, 381/122, 355, 356, 357, 358, 365
See application file for complete search history.

(56) References Cited

U.S. PATENT DOCUMENTS

| | | | | |
|---|---|---|---|---|
| 2008/0310649 | A1* | 12/2008 | Yamada | 381/92 |
| 2010/0008511 | A1* | 1/2010 | Kawano | 381/26 |

FOREIGN PATENT DOCUMENTS

| | | | | |
|---|---|---|---|---|
| JP | 51-84427 | | 7/1976 | |
| JP | H02-133095 | | 11/1990 | |
| JP | H02-134798 | | 11/1990 | |
| JP | H03-136500 | A | 6/1991 | |
| JP | H04-192799 | A | 7/1992 | |
| JP | 2007-043510 | * | 2/2007 | 5/27 |
| JP | 2007-043510 | A | 2/2007 | |
| JP | 2009-049552 | A | 3/2009 | |
| JP | 2009-171249 | A | 7/2009 | |

* cited by examiner

*Primary Examiner* — Victor A Mandala
(74) *Attorney, Agent, or Firm* — Rabin & Berdo, P.C.

(57) ABSTRACT

To provide a microphone unit for stereophonic recording capable of adjusting an intersecting angle of sound collecting axes in accordance with conditions without impairing directivity and sound quality of the microphone. Respective rotation bases (408, 508) are rotatable about a center axis with respect to mounting bases (404, 504), respectively, which are mounted to a main body (20) of a portable sound recorder (10) through respective brackets (402, 502). Respective top ends of respective knurls (414, 514) of leading ends of the respective rotation bases (408, 508) has a shape being cut to form an inclined surface from a radial direction, and respective microphones (418, 518) are retained so that diaphragms (420, 520) are in consonance with the cut surface. Accordingly, by rotation of the respective rotation bases (408, 508), sound collecting axes (426, 526) vertically extending from the diaphragms (420, 520) are changed in their axes like a precession, thereby being capable of adjusting an intersecting angle of the sound collecting axes (426, 526) of right and left microphones (418, 518).

20 Claims, 6 Drawing Sheets

MICROPHONE UNIT FOR STEREOPHONIC RECORDING

BACKGROUND OF THE INVENTION

1. Field of the Invention

The present invention relates to a microphone unit for stereophonic recording in which a pair of right and left unidirectional microphones are arranged so that respective recording axes of the pair of microphones are substantially intersected, and more particularly, to a microphone unit for stereophonic recording capable of adjusting a intersected angle of the recording axes in accordance with circumstances without deteriorating directivity and sound quality of the microphone.

2. Description of the Related Art

Several methods are in practical use as a stereophonic recording method, and an XY type is generally used because of being most general and reliable method. The XY type is a method of collecting sound by arranging a pair of right and left unidirectional microphones in an inverted V-shape so that respective recording axes of the pair of microphones are intersected. The sound collecting axis is a virtual axis line perpendicularly extending from a surface of a diaphragm for sensing sound, and agrees with a direction of the highest sensitivity of the microphone. It is possible to obtain a desired sound image by adjusting the intersecting angle of the sound collecting axes of the one pair of microphones. However, an optimal angle and microphone setting positions are varied by receiving influences caused by various conditions such as an acoustic characteristic of a sound collecting place, and hence success or failure in stereophonic recording largely depends on an experience and a technical skill of a person who sets the microphones. For that reason, there is proposed a microphone unit including two microphones each are arranged in advance so as to form an inverted V-shape without disposing two independent microphones, respectively, in which the intersecting angle of the sound collecting axes may be adjusted.

Japanese Utility Model Laid-open No. Sho. 51-84427 discloses an XY type microphone. This has such a structure that microphone elements are each mounted onto gears having the same diameter mating with each other, and a pinion is allowed to mate with one of the gears so that an opening angle of the microphone elements may be adjusted by rotating the pinion.

In the microphone unit disclosed in Japanese Utility Model Laid-open No. Sho. 51-84427, a structure of the moving part becomes complicate, and further, in order to retain the strength, respective components must be strong and big. The unidirectional microphone largely suffers influences of an area of a rear opening and a shape of an obstacle in the rear opening direction, and hence the directivity and sound quality degrade in the above-mentioned structure.

Japanese Patent Application Laid-open No. 2007-43510 discloses such a structure that right and left microphones are mounted onto the moving bases movable along a rail of a semicircular shape, thereby being capable of arbitrary adjusting the directions of the microphones.

In the microphone unit disclosed in Japanese Patent Application Laid-open No. 2007-43510, too, a scale of the structure for moving the moving bases is large, thereby causing problems of the strength and weight thereof, and in addition, it is difficult to adjust the positions of the microphones because the moving bases may be freely moved within a certain range. Further, because routing distances of signal lines connected to the microphones become larger, there was liable to cause a breakage of the lines.

SUMMARY OF THE INVENTION

It is therefore an object of the present invention to provide a microphone unit for stereophonic recording, in which it is possible to adjust an intersecting angle of sound collecting axes in accordance with conditions without impairing the directivity and sound quality of microphones.

It is another object of the present invention to provide a microphone unit for stereophonic recording, in which it is possible to easily adjust an intersecting angle of sound collecting axes.

It is still another object of the present invention to provide a microphone unit for stereophonic recording, in which it is possible to adjust an intersecting angle of sound collecting axes within a practical and preferred range.

It is still another object of the present invention to provide a microphone unit for stereophonic recording, in which it is possible to adjust an intersecting angle of sound collecting axes within an optimal.

It is still another object of the present invention to provide a microphone unit for stereophonic recording, in which it is possible to easily and correctly obtain a predetermined intersecting angle of the sound collecting axes.

It is still another object of the present invention to provide a microphone unit for stereophonic recording, in which it is possible to perform the stereophonic recording without causing a phenomenon of "center sound drop" being missing of sound of an intermediate portion between right and left.

It is still another object of the present invention to provide a microphone unit for stereophonic recording, in which it is possible to adjust an intersecting angle of sound collecting axes without changing a distance between a pair of right and left microphones.

It is still another object of the present invention to provide a microphone unit for stereophonic recording, in which it is possible to adjust an intersecting angle of sound collecting axes and a distance between the microphones at the same time.

In order to attain the above-mentioned objects of the present invention, there is provided a microphone unit for stereophonic recording, including a pair of right and left unidirectional microphones, which are arranged so that respective sound collecting axes of the pair of right and left unidirectional microphones are substantially intersected; in which, while keeping such a state that the sound collecting axis and a rotation axis of a rotation base of at least one of the pair of right and left unidirectional microphone are directed to different directions, at least one of the pair of right and left unidirectional microphones is mounted onto the rotation base rotating about the rotation axis.

In the microphone unit for stereophonic recording according to the present invention, at least one of the microphones is mounted onto the rotation base, and if the rotation base is rotated, the sound collecting axis and the rotation axis are directed to different directions. Accordingly, the direction of the sound collecting axis of the microphone changes as if an axis of rotation performing precession, and hence the angle intersecting with the sound collecting axis of the other microphone changes.

In the microphone unit for stereophonic recording according to the present invention, both of the pair of right and left unidirectional microphones may be each mounted onto a pair of right and left corresponding rotation bases. If the rotation bases are rotated so that the both microphones become rotational positions of bilateral symmetry, it is possible to adjust the intersecting angle of the sound collecting axes while retaining a center of the stereophonic recording.

Further, in the microphone unit for stereophonic recording according to the present invention, angles between the respective sound collecting axes of the pair of right and left unidirectional microphones and the rotation axes of the pair of right and left rotation bases, to which the pair of right and left unidirectional microphones are mounted, may be identical for each pair, and the angles each may be set to any certain angle within a range of from 5 to 10 degrees. With this structure, it becomes possible to adjust the intersecting angle of the sound collecting axes within the practical and preferred range. Specifically, in this case, the intersecting angle of the both sound collecting axes may be changed within a range of from 20 to 40 degrees, which may substantially cope with the range of the intersecting angles actually used.

Further, in the microphone unit for stereophonic recording according to the present invention, each of the angles between the respective sound collecting axes of the pair of right and left unidirectional microphones and the rotation axes of the pair of right and left rotation bases, to which the pair of right and left unidirectional microphones are mounted, is 7.5 degrees. The intersecting angle of the sound collecting axes of this case changes within a range of 30 degrees, which may cope with an optimal angle of from 90 to 120 degrees, for instance.

Further, in the microphone unit for stereophonic recording of the present invention, the at least one of the rotation base, onto which the at least one of the pair of right and left unidirectional microphones is mounted, is rotatable by 180 degrees between a rotational position at which an angle between one of the pair of right and left unidirectional microphones and another one of the pair of right and left unidirectional microphones becomes a maximum and a rotational position at which an angle between one of the pair of right and left unidirectional microphones and another one of the pair of right and left unidirectional microphones becomes a minimum. Therefore, it is possible to easily and correctly set the intersecting angle of the sound collecting axes to a predetermined angle, for example, 90 degrees and 120 degrees. It should be noted that "angle between the respective sound collecting axes" herein indicates an angle between the respective sound collecting axes which are projected on a plane expanding in a horizontal direction in the case where the two microphones are arranged to be shifted relative to a perpendicular direction (on an assumption that two sound collecting axes each are extending in a horizontal direction, a direction orthogonal to either of the axes).

Further, in the microphone unit for stereophonic recording according to the present invention, when the rotation base is positioned at least at a predetermined rotational position, the at least one of the pair of right and left unidirectional microphones is arranged to be shifted in a perpendicular direction so that an intersecting axis included in any of respective diaphragms of the pair of right and left unidirectional microphones forms a substantially right angle to the respective sound collecting axes. Specifically, the pair of right and left microphones are arranged so as to be overlapped in a vertical direction, whereby the phenomenon of "center sound drop" being missing of sound of the intermediate portion between right and left may be prevented.

Further, the microphone unit for stereophonic recording according to the present invention has such a structure that an intersection between the sound collecting axis of the at least one of the pair of right and left unidirectional microphones and the rotational axis of the rotation base, to which the at least one of the pair of right and left unidirectional microphones is mounted, is substantially included on the surface of the diaphragm. Accordingly, even if the rotation base is rotated, a distance between the both microphones hardly changes, and hence it is possible to change only the intersecting angle of the sound collecting axes.

Further, the microphone unit for stereophonic recording according to the present invention has such a structure that an intersection between the sound collecting axis of the at least one of the pair of right and left unidirectional microphones and the rotational axis of the rotation base, to which the at least one of the pair of right and left unidirectional microphones is mounted, is apart from the surface of the diaphragm. Accordingly, if the rotation base is rotated, one of the microphones approaches and separates with respect to another of the microphones, thereby being capable of changing the distance between the both microphones.

As described above, the microphone unit for stereophonic recording according to the present invention has such a structure that, by the rotation of the rotation base, the intersecting angle of the respective sound collecting axes of the pair of right and left microphones may be adjusted, and hence the moving part arranged behind the microphone is only a mechanism for rotating the rotation base, thereby being capable of realizing the moving part with simple and a small size. As a result, it is possible to eliminate or suppress to minimum the influences by the moving part exerted on the directivity and sound quality of the unidirectional microphones.

DETAILED DESCRIPTION OF THE PREFERRED EMBODIMENT

Hereinafter, description is made of an embodiment of the present invention. It should be noted that the following description is made for understanding the invention more deeply, but is not intended to limit the scope of the present invention.

Figure 1:
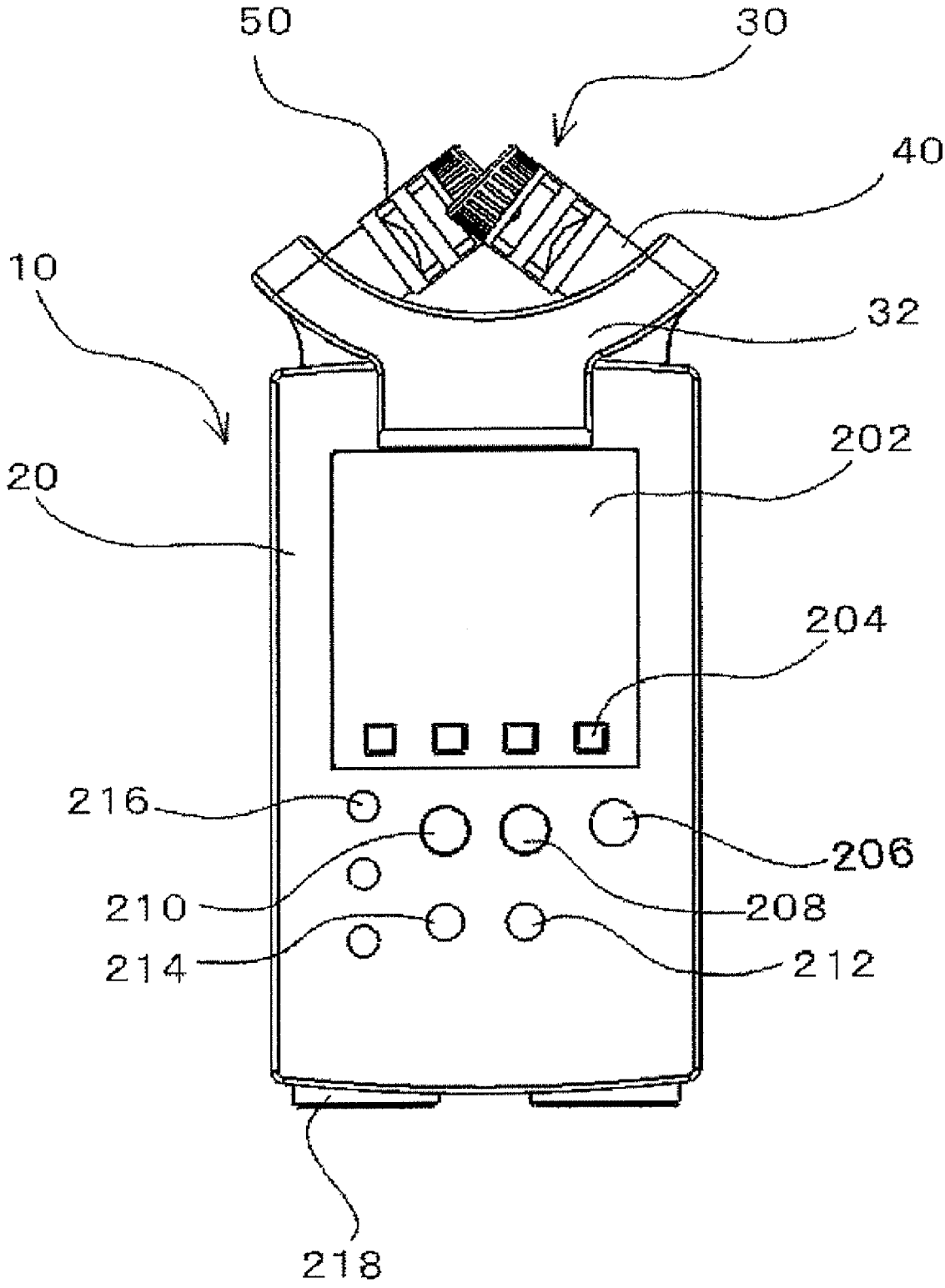
FIG. 1 is a front view illustrating a portable sound recorder provided with a microphone unit for stereophonic recording according to an embodiment of the present invention.
Figure 2:
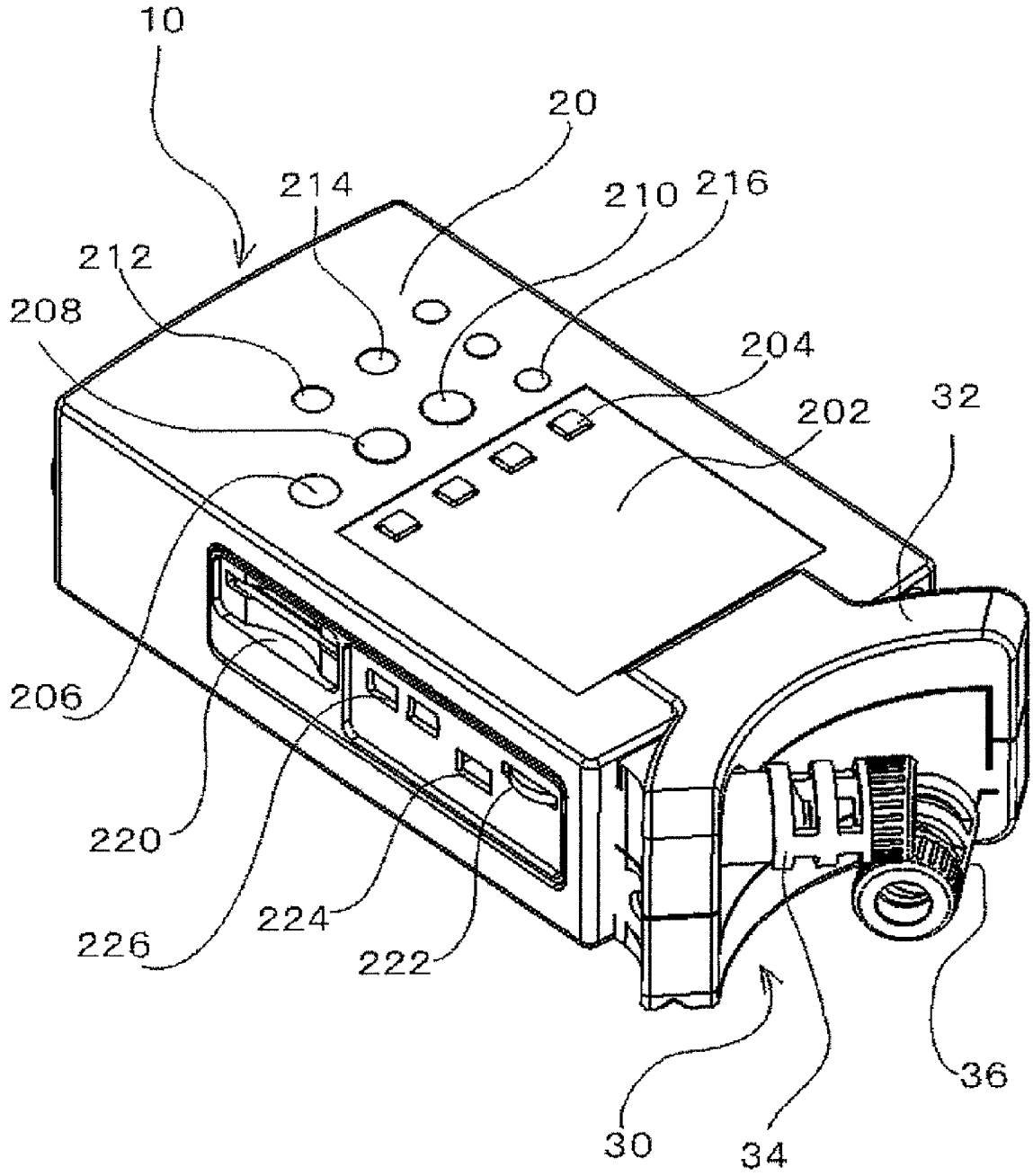
FIG. 2 is a perspective view illustrating the portable sound recorder of FIG. 1.

FIGS. 1 and 2 each are a front view and a perspective view of a portable sound recorder to which a microphone unit for stereophonic recording according to an embodiment of the present invention is applied.

In each of FIGS. 1 and 2, a portable sound recorder 10 includes a main body 20 having a rectangular shape, and a microphone unit 30 which is provided and projected from a front end of the main body 20.

Provided on a top surface of the main body 20 is a liquid crystal display 202 for indicating a current status of the portable sound recorder 10, such as a recording time, a recording level, and a battery remaining amount. Behind the liquid crystal display 202, there are provided four track selection keys 204 for selecting a track when multi-track recording. Further behind the track selection keys 204, there are arranged a recording key 206, a reproduction key 209, a stop key 210, a rapid traverse key 212, a rewind key 214, and three input selection keys 216 aligned in a front and rear direction. Two external input terminals 218 are provided at the rear end of the main body 20. On a right side surface of the main body 20, there are provided an SD card slot 220, a jog dial 222, a mike gain switch 224, and two input gain switches 226. Detailed descriptions of the functions of those keys and switches are omitted, because there is no direct relation with the present invention.

The microphone unit 30 is constructed such that a right microphone part 40 and a left microphone part 50 each are fixed at near both right and left ends of an inverted arch-shape base 32 projected from a front end of the main body 20. Although the detail thereof is described later, the right microphone part 40 and the left microphone part 50 are arranged so that the respective sound collecting axes are substantially orthogonal. Accordingly, at the stereophonic recording, the right microphone part 40 collects sound generated from a front left side, and on the contrary, the left microphone part 50 collects sound generated from a front right side. Further, the right microphone part 40 and the left microphone part 50 are arranged so that the right microphone part 40 overlaps with the left microphone part 50, whereby the phenomenon of "center sound drop" being missing of sound of an intermediate portion between right and left is prevented.

Figure 3:
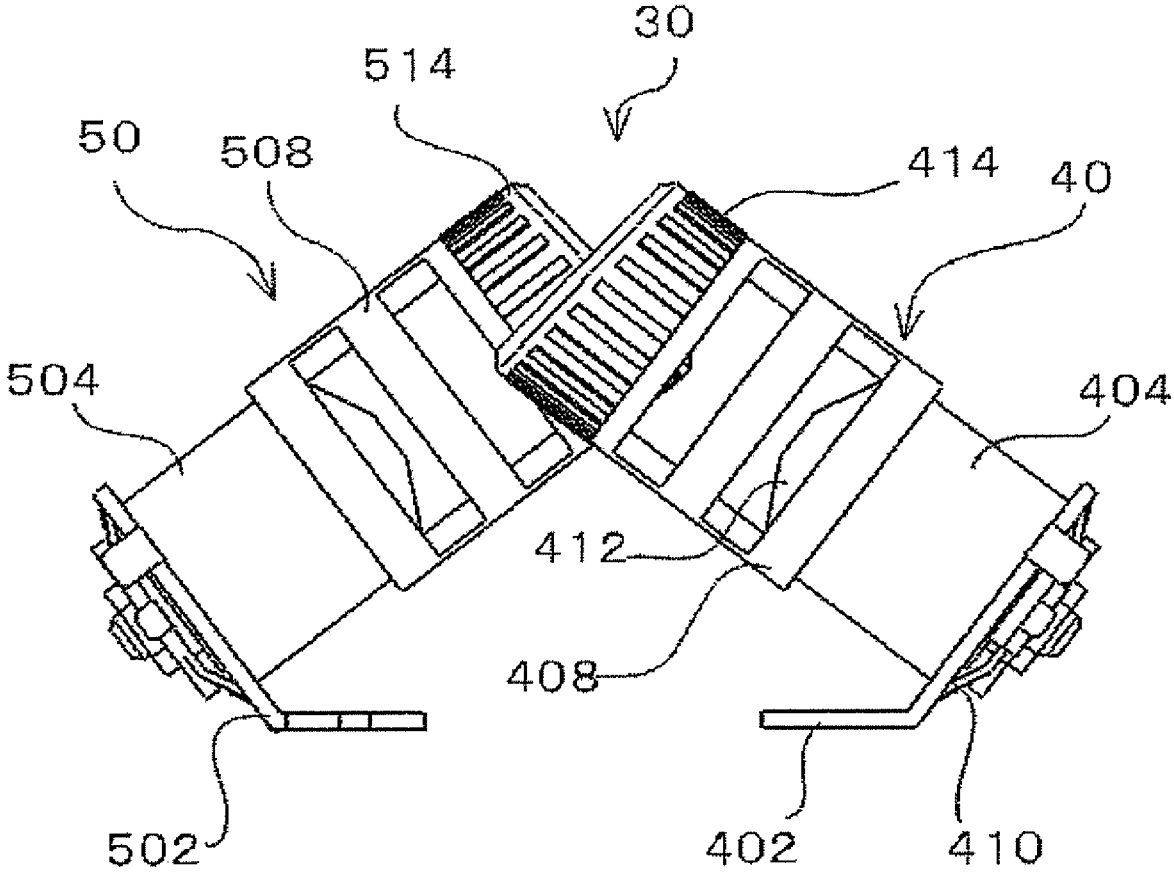
FIG. 3 is a partial enlarged front view of the microphone unit illustrated in FIGS. 1 and 2.
Figure 4:
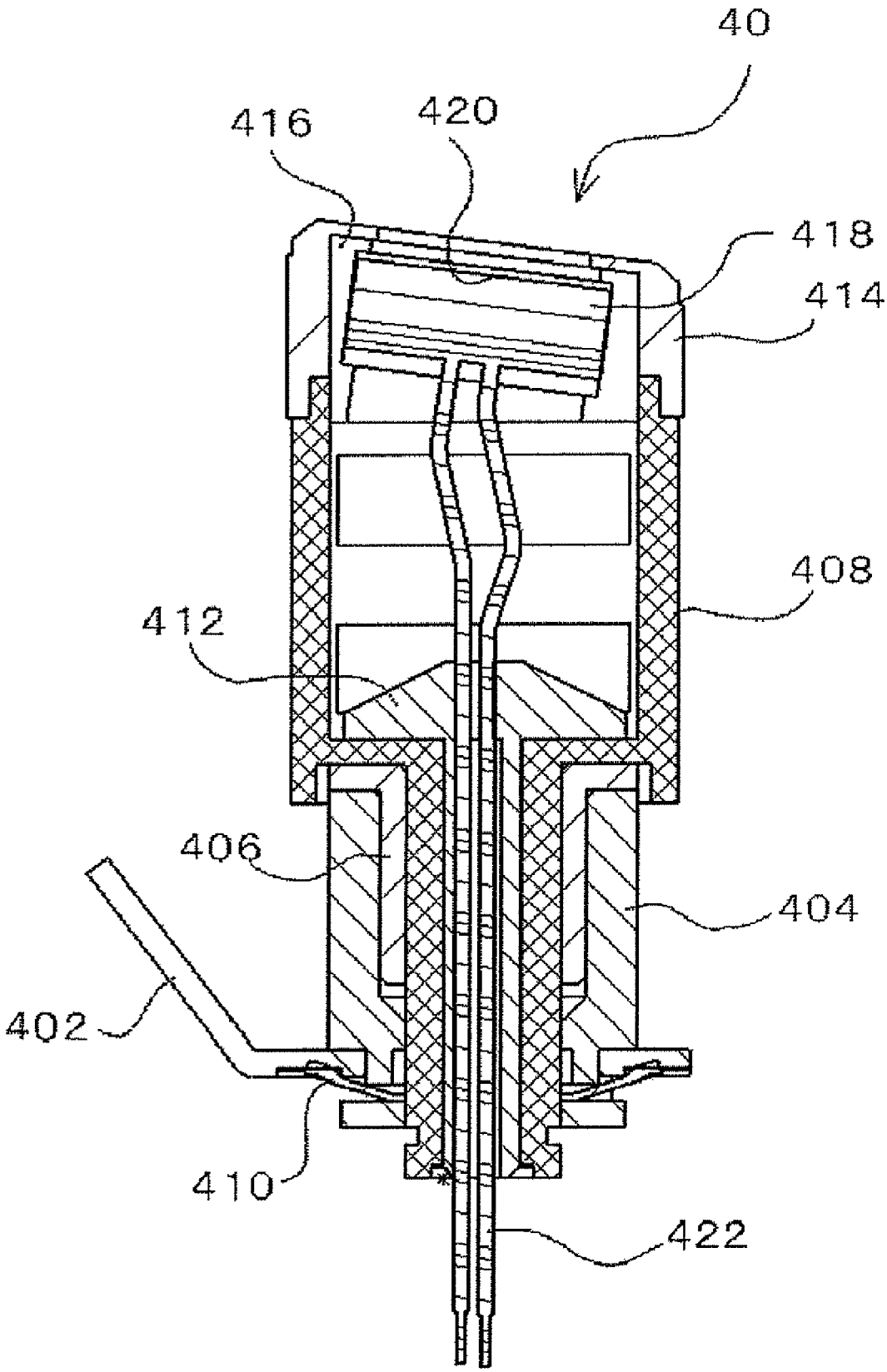
FIG. 4 is a cross-sectional view illustrating a right microphone section of the microphone unit illustrated in FIG. 3.

FIG. 3 is an enlarged frontal view illustrating the microphone unit 30 excluding the base 32. FIG. 4 is a further enlarged cross-sectional view of the microphone unit 30 illustrating the right microphone part 40 in a posture in which the rotation axis is directed to a longitudinal direction of the drawing.

The right microphone part 40 and the left microphone part 50 are mounted onto a base 32 so as to form an inverted V-shape as illustrated in FIG. 3. As described above, the right microphone part 40 and the left microphone part 50 are arranged to be shifted in a vertical direction. However, when projecting them onto a horizontal plane, an angle formed by both the rotation axes (described later) is set to 105 degrees. The right microphone part 40 and the left microphone part 50 each have the same structure, and hence detailed description is made of the right microphone part 40.

The right microphone part 40 includes a bracket 402, a mounting base 404, a bearing 406, a rotation base 408, a plate spring 410, a signal line protection cylinder 412, a knurl 414, a microphone retainer 416, and a right microphone 418.

The bracket 402 is made of a metal, and is mounted onto a base 20 to fix the right microphone part 40 onto the base 20. A plastic-made mounting base 404 has a cylindrical shape having openings at both ends, and is fixed to the bracket 402. On an inner peripheral surface of the mounting base 404, there is provided at an upper end thereof a flange formed to have the same outer diameter with the diameter of the mounting base, and the plastic-made bearing 406 having a cylindrical shape and having openings at both ends is fitted into the flange.

The bearing 406 rotatably retains an axial part of the metal-made rotation base 408. With this structure, the rotation base 408 is rotatable about the center axis with respect to the mounting base 404. The rotation base 408 has such a shape that two cylinders having different diameters are connected while having a common center axis, and the outer peripheral surface of the cylindrical portion having a smaller diameter is retained rotatably by the bearing 406 to project until the beneath of the bracket 402. At a portion projecting below the bracket 402 of the cylindrical portion having a smaller diameter of the rotation base 408, the plate spring 410 is fixed, and both ends thereof may enter into two grooves, respectively, formed on the bracket 402. If the rotation base 408 is rotated by 180 degrees in one direction from the state in which the plate spring 410 enters, both ends of the plate spring 410 enter into the other grooves with a click feeling, respectively, from the one grooves into which the both ends entered, and further rotation in the one direction is limited. If the rotation base 408 is rotated in the other direction by 180 degrees, the both ends of the plate spring 410 enter the one grooves again with a click feeling, and in this state, further rotation in the other direction is limited. With this structure, the rotation of the rotation base 408 is available within a range of 180 degrees. The cylindrical portion having a smaller diameter of the rotation base 408 is provided so as to project from a lower end surface of the cylindrical portion having a larger diameter. To the cylindrical portion having a larger diameter, there are formed a plurality of windows for eliminating or suppressing at minimum the influences exerted on the directivity and sound quality of the microphone. The lower end of the cylindrical portion having a smaller diameter and the upper end of the cylindrical portion having a larger diameter of the rotation base 408 each have an opening.

The overall of the inner peripheral surface of the cylindrical portion having a smaller diameter is covered with the signal line protection cylinder 412 having an umbrella shape. The signal line protection cylinder 412 serves to prevent a signal line 422 of the right microphone 418 described later from being damaged by direct contact with the metal-made rotation base 408. In the signal line protection cylinder 412, the umbrella portion is engaged on the lower end surface of the cylindrical portion having a larger diameter of the rotation base 408, and a grip portion extending from the umbrella portion to the beneath is tightly interpenetrated into the cylindrical portion having a smaller diameter of the rotation base 408. The signal line protection cylinder 412 is provided with a hole for allowing the signal line 422 to pass therethrough along the center axis.

The knurl 414 made of metal is fitted to the top end of the rotation base 408. The rotatable portion of the right microphone part 40 may be rotated by nipping the knurl 414 with fingers. The knurl 414 also has a cylindrical shape in which both ends thereof are opened. However, the top end thereof has a shape being cut in an inclined direction from the radial direction of the knurl 414, that is, a shape being cut by the inclined surface in which the right direction becomes lower than the horizontal of FIG. 4. The angle of the cut surface of the top end of the knurl 414 is 7.5 degrees from the horizontal.

The plastic-made microphone retainer 416 is inserted into an inner peripheral surface of the knurl 414. The microphone retainer 416 has a shape in which the top end thereof is cut to form an inclined surface from the horizontal surface of FIG. 4 as well as the knurl 414, and the center axis of the inner peripheral surface of the portion for retaining the right microphone 418 provided inside the microphone retainer 416 is inclined in the same direction with the cut surface of the top end by the same angle from the perpendicular direction of FIG. 4.

The right microphone 418 retained by the microphone retainer 416 has a single directivity, and an outer shape thereof is cylindrical. The right microphone 418 has the diaphragm at the top end thereof, and two signal lines 422 are extending from the lower end surface thereof (not shown in FIG. 3). The signal lines 422 pass through the rotation base 408 and the signal line protection cylinder 412, and are connected to a microphone input terminal (not shown) inside the main body 20 of the portable sound recorder 10.

Because the right microphone 418 is retained with an inclined state by the microphone retainer 416 as illustrated in FIG. 4, the diaphragm 420 of the right microphone 418 is also inclined. The sound collecting axis extending from the center of the diaphragm 420 in a perpendicular direction with respect to the diaphragm 420 is also inclined to right by 7.5 degrees from a perpendicular direction of FIG. 4.

Specifically, in FIG. 4, the rotation axis of the rotation base 408 extends in a vertical direction of FIG. 4, and the sound collecting axis of the right microphone 418 is inclined to right by 7.5 degrees from the perpendicular direction of FIG. 4. Accordingly, if the rotation base 408 is rotated, the direction of the sound collecting axis of the right microphone 418 changes as if an axis of rotation performing precession. With this, the microphone unit 30 of this embodiment may change the intersecting angle of the respective sound collecting axes of the right and left microphones. Hereinbelow, the action thereof is described with reference to FIG. 5.

Figure 5:
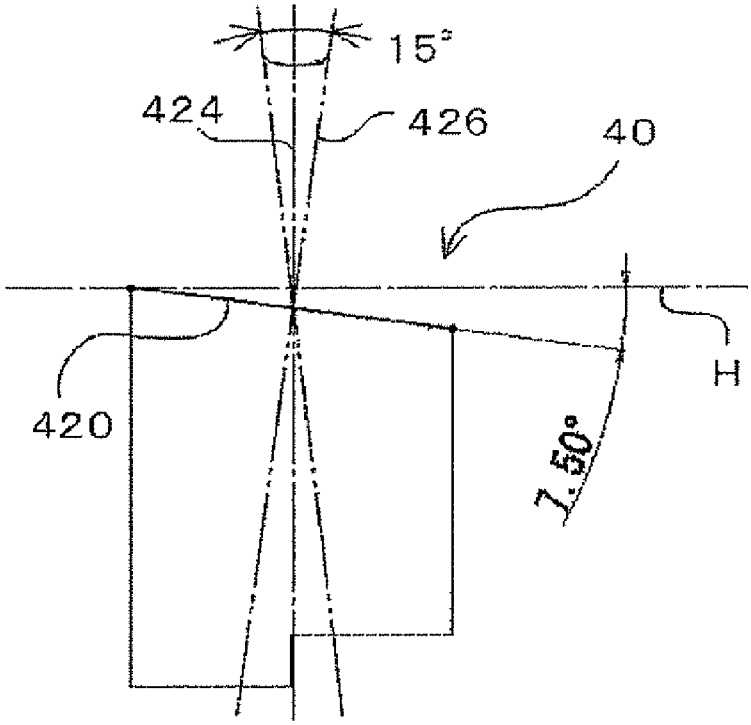
FIG. 5 is a diagram explaining a relation between a rotation axis of a rotation base of the right microphone section illustrated in FIG. 4 and a sound collecting axis of the microphone.

FIG. 5 is a diagram explaining movement of the sound collecting axis of the right microphone part 40. As described above, the diaphragm 420 of the right microphone part 40 is inclined by 7.5 degrees so that the right direction becomes lower than a horizontal line H on FIG. 5. On the other hand, the rotation axis 424, about which the right microphone part 40 rotates, extends in a perpendicular direction as shown in FIG. 5. Accordingly, the sound collecting axis 426 extending in a perpendicular direction from the center of the diaphragm 420 to the surface of the diaphragm 420 is inclined by 7.5 degrees with respect to the rotation axis 424.

For that reason, if the right microphone part 40 is rotated, as the posture of the diaphragm 420 changes, the sound collecting axis 426 changes its direction like the precession while keeping the inclined angle of 7.5 degrees with respect to the rotation axis 424. In this embodiment, the right microphone 418 rotates within a range of 180 degrees, as illustrated in FIG. 5, the angle of the sound collecting axis 426 with respect to the rotation axis 424, which is viewed from a frontal direction, changes by 15 degrees.

Figure 6:
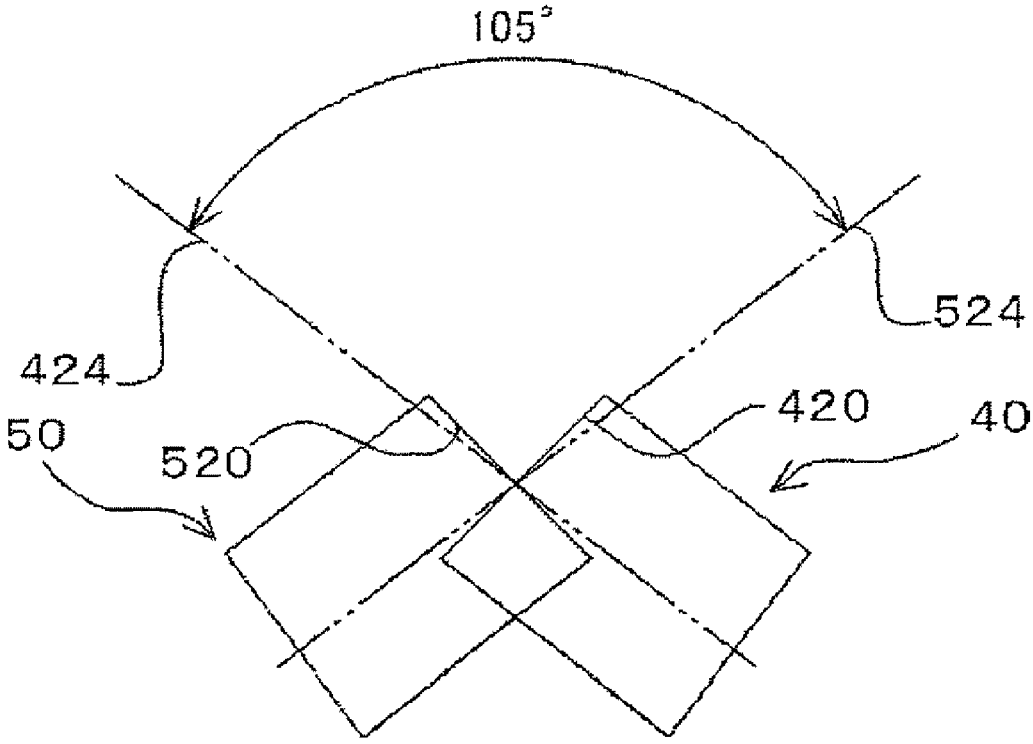
FIG. 6 is a diagram explaining an angle of rotation axes of a right and left microphones illustrated in FIG. 3.
Figure 7:
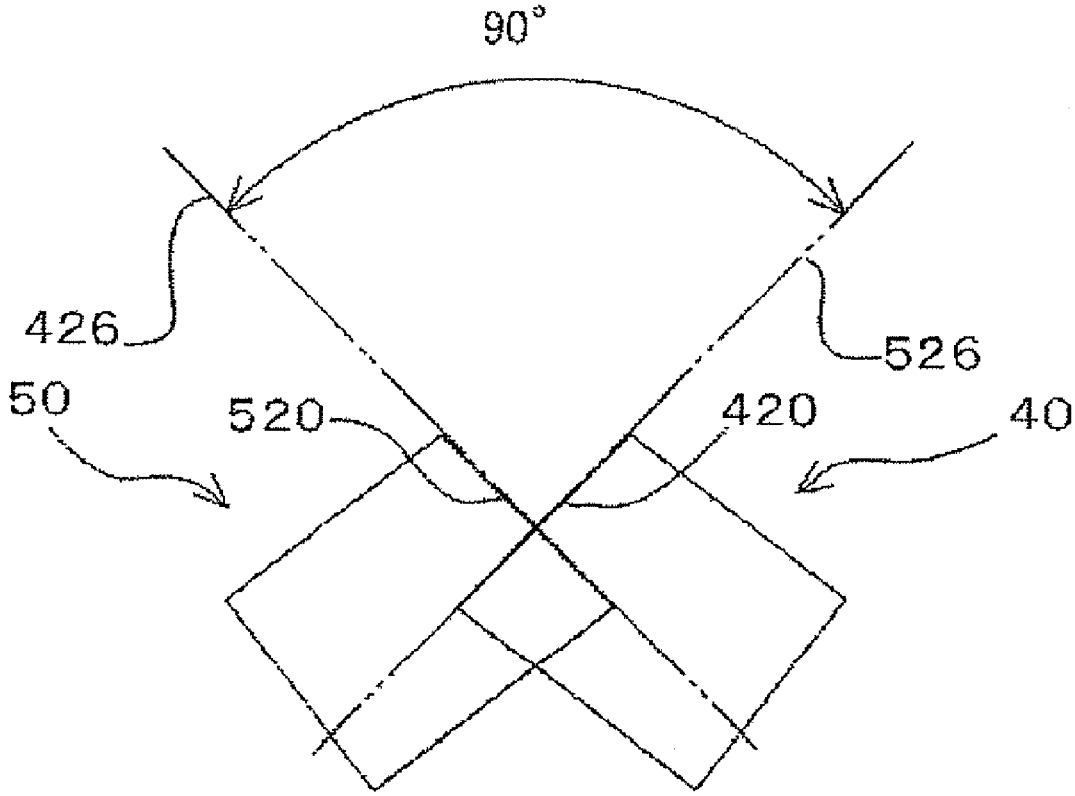
FIG. 7 is a diagram explaining an angle between the sound collecting axes of the right and left microphones with a state illustrated in FIG. 6.
Figure 8:
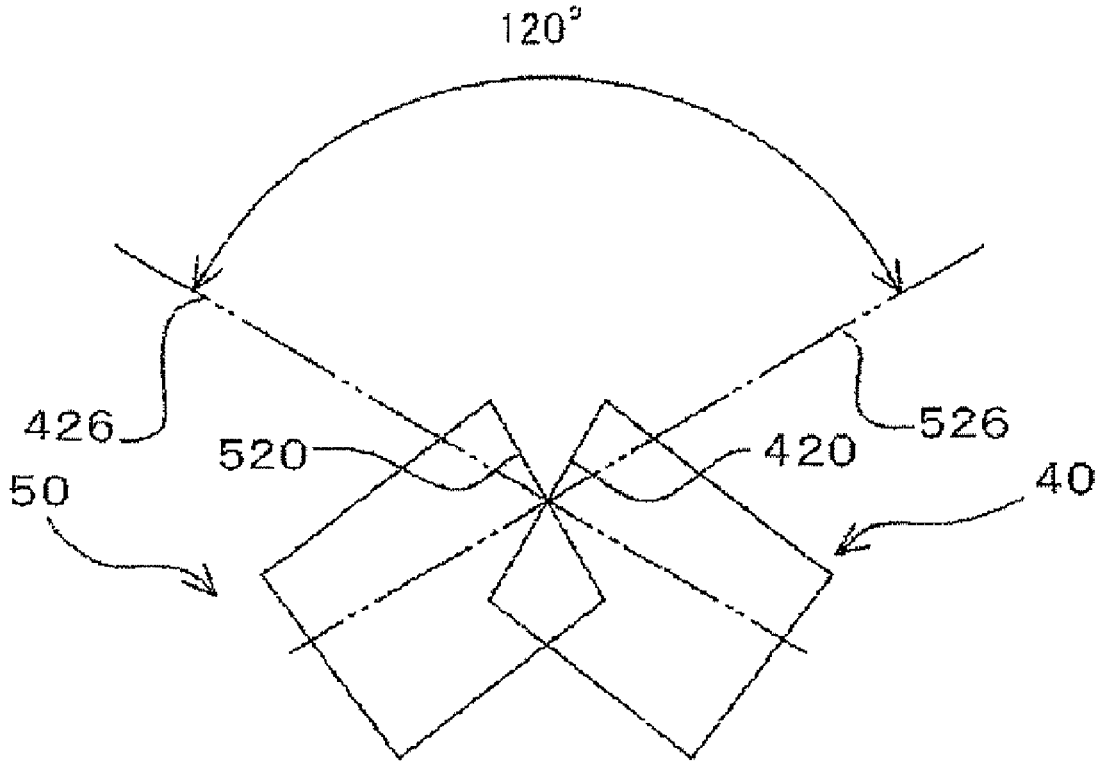
FIG. 8 is a diagram explaining the angle between the sound collecting axes of the right and left microphones at a state after rotating the respective rotation angles of the right and left microphones by 180 degrees from the state illustrated in FIG. 7.

FIG. 6 is a diagram illustrating a positional relationship between the right and left microphone parts 40 and 50. The right microphone part 40 and the left microphone part 50 are arranged so that the respective rotation axes 424 and 524, as illustrated in FIG. 6, form a right angle of 105 degrees on the projection drawing onto the horizontal surface. When any of the right and left microphone parts 40 and 50 are positioned at the same rotational positions as illustrated in FIG. 6, as illustrated in FIG. 7, the respective sound collecting axes 426 and 526 form an intersecting angle of 90 degrees as viewed from FIG. 7. Next, when the right and left microphone parts 40 and 50 are rotated by 180 degrees about the rotation axes 424 and 524, as illustrated in FIG. 8, the respective sound collecting axes 426 and 526 intersect with each other by 120 degrees as viewed from FIG. 8.

As described above, the microphone unit 30 according to the present invention is constructed such that, by the rotation of the pair of right and left rotation bases 408 and 508, which are rotatable with respect to the main body 20, it is possible to adjust the intersecting angle of the respective sound collecting axes 426 and 526 of the pair of right and left microphones 418 (518, not shown) mounted onto the respective rotation bases 408 and 508, and the moving part arranged behind the microphones 418(518) is only a mechanism for rotating the rotation base, thereby being capable of realizing the mechanism with simple and small size. Therefore, it is possible to easily adjust an optimum intersecting angle of the sound collecting axes of the right and left microphones, the optimum intersecting angle being changed depending on the sound collecting condition. It is also possible to eliminate or suppress at a minimum influences exerted on the directivity and sound quality of the unidirectional microphone.

In the microphone unit 30 according to the present invention, both the pair of right and left microphones 418 and 518 are mounted onto a pair of corresponding right and left rotation bases 408 and 508, respectively. With this structure, by the rotation of the rotation bases 408 and 508 so that the both microphones 418 and 518 each become the rotational positions of bilateral symmetry, it is possible to adjust the intersecting angle of the sound collecting axes 426 and 526 while retaining a center of the stereophonic recording.

In the microphone unit 30 according to the present invention, each of the angles between the respective sound collecting axes 426 and 526 of the pair of right and left microphones 418 and 518 and the rotation axes 424 and 524 of the pair of right and left rotation bases 408 and 508, to which the pair of right and left unidirectional microphones 418 and 518 are mounted, are the same, and the angle is set to 7.5 degrees within a practical and preferred range of 5 to 10 degrees. With this structure, it is possible to adjust the intersecting angle of the sound collecting axes 426 and 526 within an optimum range, that is, it is possible to cope with the range of from 90 to 120 degrees.

In the microphone unit according to the present invention, through regulation of the rotation by the plate springs 410 and 510 and the brackets 402 and 502, each of the rotation bases 408 and 508, onto which the pair of right and left microphones 418 and 518 are mounted, is rotatable by 180 degrees between a rotational position at which the angle between the respective sound collecting axes 426 and 526 of the respective microphones 418 and 518 becomes a maximum and a rotational position at which the angle between the respective sound collecting axes 426 and 526 of the respective microphones 418 and 518 becomes a minimum. Therefore, it is possible to easily and correctly set the intersecting angle between the sound collecting axes 426 and 526 to predetermined 90 degrees and 120 degrees.

In the microphone unit according to the present invention, when the rotation bases 408 and 508 are positioned at such rotational positions that the intersecting angle between the sound collecting axes 426 and 526 becomes 90 degrees and 120 degrees, the pair of right and left microphones 418 and 518 are arranged to be shifted in a perpendicular direction so that the intersecting axis included in any of the respective diaphragms 420 and 520 of the pair of right and left microphones 418 and 518 forms a substantially right angle to the respective sound collecting axes 426 and 526. Referring to FIGS. 6 to 8, the intersection of the respective sound collecting axes 426 and 526 agrees with the intersection on the horizontal projection plane on the surface of the respective diaphragms 420 and 520, and hence the virtual intersecting axis line extends in a perpendicular direction from the plane (not shown). Specifically, the pair of right and left microphones 418 and 518 are arranged so as to be overlapped in a vertical direction, whereby the phenomenon of "center sound drop" being missing of sound of the intermediate portion between right and left may be prevented.

The microphone unit for stereophonic recording according to this embodiment is constructed such that the intersections between the sound collecting angles 426 and 526 of the pair of right and left microphones 41B and 518 and the rotation axes 424 and 524 of the rotation bases 408 and 508, onto which the respective microphones 418 and 518 are mounted are substantially included on the surfaces of the diaphragms 420 and 520 or the respective microphones 418 and 518. Accordingly, if the rotation bases 408 and 508 are rotated, the distance between the both microphones 418 and 518 hardly changes, thereby being capable of changing only the intersecting angle between the sound collecting axes 426 and 526.

The microphone unit for stereophonic recording according to another embodiment of the present invention may be structured such that the intersection between the sound collecting axis of the at least one of the microphones and the rotation axis of the rotation base, onto which the microphone is mounted, is apart from the surface of the diaphragm. Accordingly, if the rotation base is rotated, one of the microphones approaches and separates with respect to another of the microphones, to thereby change the distance between the both microphones. As a result, the microphone unit of the present invention may adapt to the condition in which the angle of the sound collecting axes and the distance between the pair of right and left microphones are adjusted at the same time.

As described above, the embodiments of the present invention are described, but the present invention is not limited by the above-mentioned embodiments, and it is needless to say that the present invention may be appropriately modified and embodied within the scope of the present invention.

What is claimed is:

1. A microphone unit for stereophonic recording, comprising:

a pair of right and left unidirectional microphones configured so that respective sound collecting axes of the pair of right and left unidirectional microphones are substantially intersected;

at least one of the pair of right and left unidirectional microphones being mounted onto a rotation base rotating about a rotation axis, while the sound collecting axis and the rotation axis of the rotation base of at least one of the pair of right and left unidirectional microphones are directed to different directions;

wherein rotation of the rotation base includes adjusting an angle between the respective sound collecting axes of the pair of right and left unidirectional microphones.

2. The microphone unit for stereophonic recording according to claim 1, wherein both of the pair of right and left unidirectional microphones are each mounted onto a pair of right and left corresponding rotation bases.

3. The microphone unit for stereophonic recording according to claim 2, wherein angles between the respective sound collecting axes of the pair of right and left unidirectional microphones and the rotation axes of the pair of right and left rotation bases, to which the pair of right and left unidirectional microphones are mounted, are identical for each pair, and the angles are each set to any certain angle within a range of from 5 to 10 degrees.

4. The microphone unit for stereophonic recording according to claim 3, wherein each of the angles between the respective sound collecting axes of the pair of right and left unidirectional microphones and the rotation axes of the pair of right and left rotation bases, to which the pair of right and left unidirectional microphones are mounted, is 7.5 degrees.

5. The microphone unit for stereophonic recording according to claim 1, wherein the rotation base, onto which the at least one of the pair of right and left unidirectional microphones is mounted, is rotatable by 180 degrees between a rotational position at which an angle between one of the pair of right and left unidirectional microphones and another one of the pair of right and left unidirectional microphones becomes a maximum and a rotational position at which an angle between one of the pair of right and left unidirectional microphones and another one of the pair of right and left unidirectional microphones becomes a minimum.

6. The microphone unit for stereophonic recording according to claim 1, wherein, when the rotation base is positioned at least at a predetermined rotational position, the at least one of the pair of right and left unidirectional microphones is arranged to be shifted in a perpendicular direction so that an intersecting axis included in any of respective diaphragms of the pair of right and left unidirectional microphones forms a substantially right angle to the respective sound collecting axes.

7. The microphone unit for stereophonic recording according to claim 1, wherein an intersection between the sound collecting axis of the at least one of the pair of right and left unidirectional microphones and the rotational axis of the rotation base, to which the at least one of the pair of right and left unidirectional microphones is mounted, is substantially included on the surface of the diaphragm.

8. The microphone unit for stereophonic recording according to claim 1, wherein an intersection between the sound collecting axis of the at least one of the pair of right and left unidirectional microphones and the rotational axis of the rotation base, to which the at least one of the pair of right and left unidirectional microphones is mounted, is apart from the surface of the diaphragm.

9. The microphone unit for stereophonic recording according to claim 2, wherein the rotation base, onto which the at least one of the pair of right and left unidirectional microphones is mounted, is rotatable by 180 degrees between a rotational position at which an angle between one of the pair of right and left unidirectional microphones and another one of the pair of right and left unidirectional microphones becomes a maximum and a rotational position at which an angle between one of the pair of right and left unidirectional microphones and another one of the pair of right and left unidirectional microphones becomes a minimum.

10. The microphone unit for stereophonic recording according to claim 3, wherein the rotation base, onto which the at least one of the pair of right and left unidirectional microphones is mounted, is rotatable by 180 degrees between a rotational position at which an angle between one of the pair of right and left unidirectional microphones and another one of the pair of right and left unidirectional microphones becomes a maximum and a rotational position at which an angle between one of the pair of right and left unidirectional microphones and another one of the pair of right and left unidirectional microphones becomes a minimum.

11. The microphone unit for stereophonic recording according to claim 4, wherein the rotation base, onto which the at least one of the pair of right and left unidirectional microphones is mounted, is rotatable by 180 degrees between a rotational position at which an angle between one of the pair of right and left unidirectional microphones and another one of the pair of right and left unidirectional microphones becomes a maximum and a rotational position at which an angle between one of the pair of right and left unidirectional microphones and another one of the pair of right and left unidirectional microphones becomes a minimum.

12. The microphone unit for stereophonic recording according to claim 2, wherein, when the rotation base is positioned at least at a predetermined rotational position, the at least one of the pair of right and left unidirectional microphones is arranged to be shifted in a perpendicular direction so that an intersecting axis included in any of respective diaphragms of the pair of right and left unidirectional microphones forms a substantially right angle to the respective sound collecting axes.

13. The microphone unit for stereophonic recording according to claim 3, wherein, when the rotation base is positioned at least at a predetermined rotational position, the at least one of the pair of right and left unidirectional microphones is arranged to be shifted in a perpendicular direction so that an intersecting axis included in any of respective diaphragms of the pair of right and left unidirectional microphones forms a substantially right angle to the respective sound collecting axes.

14. The microphone unit for stereophonic recording according to claim 4, wherein, when the rotation base is positioned at least at a predetermined rotational position, the at least one of the pair of right and left unidirectional microphones is arranged to be shifted in a perpendicular direction so that an intersecting axis included in any of respective diaphragms of the pair of right and left unidirectional microphones forms a substantially right angle to the respective sound collecting axes.

15. The microphone unit for stereophonic recording according to claim 2, wherein an intersection between the sound collecting axis of the at least one of the pair of right and left unidirectional microphones and the rotational axis of the rotation base, to which the at least one of the pair of right and left unidirectional microphones is mounted, is substantially included on the surface of the diaphragm.

16. The microphone unit for stereophonic recording according to claim 3, wherein an intersection between the sound collecting axis of the at least one of the pair of right and left unidirectional microphones and the rotational axis of the rotation base, to which the at least one of the pair of right and left unidirectional microphones is mounted, is substantially included on the surface of the diaphragm.

17. The microphone unit for stereophonic recording according to claim 4, wherein an intersection between the sound collecting axis of the at least one of the pair of right and left unidirectional microphones and the rotational axis of the rotation base, to which the at least one of the pair of right and left unidirectional microphones is mounted, is substantially included on the surface of the diaphragm.

18. The microphone unit for stereophonic recording according to claim 2, wherein an intersection between the sound collecting axis of the at least one of the pair of right and left unidirectional microphones and the rotational axis of the rotation base, to which the at least one of the pair of right and left unidirectional microphones is mounted, is apart from the surface of the diaphragm.

19. The microphone unit for stereophonic recording according to claim 3, wherein an intersection between the sound collecting axis of the at least one of the pair of right and left unidirectional microphones and the rotational axis of the rotation base, to which the at least one of the pair of right and left unidirectional microphones is mounted, is apart from the surface of the diaphragm.

20. The microphone unit for stereophonic recording according to claim 4, wherein an intersection between the sound collecting axis of the at least one of the pair of right and left unidirectional microphones and the rotational axis of the rotation base, to which the at least one of the pair of right and left unidirectional microphones is mounted, is apart from the surface of the diaphragm.

* * * * *